US011248316B2

(12) United States Patent
Verstraeten

(10) Patent No.: US 11,248,316 B2
(45) Date of Patent: Feb. 15, 2022

(54) ELECTROMAGNETIC SHIELDING FABRIC AND YARN FOR ITS MANUFACTURE

(71) Applicant: NV Bekaert SA, Zwevegem (BE)

(72) Inventor: Steve Verstraeten, Antwerp (BE)

(73) Assignee: NV BEKAERT SA, Zwevegem (BE)

( * ) Notice: Subject to any disclaimer, the term of this patent is extended or adjusted under 35 U.S.C. 154(b) by 343 days.

(21) Appl. No.: 16/337,095

(22) PCT Filed: Dec. 5, 2017

(86) PCT No.: PCT/EP2017/081528
§ 371 (c)(1),
(2) Date: Mar. 27, 2019

(87) PCT Pub. No.: WO2018/104303
PCT Pub. Date: Jun. 14, 2018

(65) Prior Publication Data

US 2020/0032430 A1 Jan. 30, 2020

(30) Foreign Application Priority Data

Dec. 6, 2016 (EP) ..... 16202315

(51) Int. Cl.

| | |
|---|---|
| ***D02G 3/44*** | (2006.01) |
| ***D02G 3/12*** | (2006.01) |
| ***D03D 1/00*** | (2006.01) |
| ***A41D 13/008*** | (2006.01) |

(52) U.S. Cl.
CPC ..... *D02G 3/12* (2013.01); *A41D 13/008* (2013.01); *D02G 3/441* (2013.01); *D03D 1/0058* (2013.01); *D03D 1/0088* (2013.01); *A41D 2500/10* (2013.01); *A41D 2500/20* (2013.01); *D10B 2101/20* (2013.01); *D10B 2401/16* (2013.01); *D10B 2501/06* (2013.01)

(58) Field of Classification Search
None
See application file for complete search history.

(56) References Cited

U.S. PATENT DOCUMENTS

| | | | | |
|---|---|---|---|---|
| 5,927,060 | A | 7/1999 | Watson | |
| 2005/0282009 | A1 | 12/2005 | Nusko et al. | |
| 2015/0118425 | A1* | 4/2015 | Dapsalmon | D02G 3/442 428/36.1 |
| 2015/0364824 | A1 | 12/2015 | Song et al. | |
| 2016/0145776 | A1 | 5/2016 | Roh | |

FOREIGN PATENT DOCUMENTS

| | | | |
|---|---|---|---|
| CN | 101194762 | | 6/2008 |
| CN | 101524188 | | 9/2009 |
| CN | 101703324 | | 5/2010 |
| DE | 94 00 193.6 | | 4/1994 |
| DE | 197 43 389 | | 4/1999 |
| EP | 0 911 435 | | 4/1999 |
| EP | 0911435 | * | 4/1999 |
| GB | 1 221 724 | | 2/1971 |
| WO | 2004/027132 | | 4/2004 |
| WO | WO2005033387 | * | 4/2005 |
| WO | 2011/096606 | | 8/2011 |

OTHER PUBLICATIONS

International Search Report dated Feb. 21, 2018 in International Application No. PCT/EP2017/081528.
Written Opinion of the International Searching Authority dated Feb. 21, 2018 in International Application No. PCT/EP2017/081528.

* cited by examiner

*Primary Examiner* — Shawn Mckinnon
(74) *Attorney, Agent, or Firm* — Wenderoth, Lind & Ponack, L.L.P.

(57) ABSTRACT

An assembled yarn comprises a first yarn and a second yarn. The first yarn comprises a core yarn and a first wrap yarn. The core yarn comprises a spun yarn, wherein the spun yarn comprises a blend of fibers, wherein the blend of fibers comprises first electrically conductive fibers. The first wrap yarn comprises or consists out of one or a plurality of metallic filaments. The first wrap yarn is wrapped around the core yarn with at least 300 turns per meter. The second yarn comprises second electrically conductive fibers. The second yarn is wrapped around the first yarn; or the second yarn is ply-twisted with the first yarn thereby forming a plied yarn. The assembled yarn can be used in electromagnetic shielding fabrics.

14 Claims, No Drawings

ELECTROMAGNETIC SHIELDING FABRIC AND YARN FOR ITS MANUFACTURE

TECHNICAL FIELD

The invention relates to the technical field of electromagnetic shielding fabrics, e.g. used in the manufacturing of protective clothing. An example is protective clothing for workers working near high-voltage electricity lines, transformers, switches, railway cables; and for other shielding, e.g. against high frequency or electromagnetic radiation. The invention further relates to fabrics and protective clothing satisfying the requirements of standard CEI/IEC 60895: 2002 of the International Electrotechnical Commission). The invention further relates to yarns for the production of such electromagnetic shielding fabrics.

BACKGROUND ART

CN101703324A discloses an AC high voltage shielding thermal insulation suit. Each part of the shielding thermal insulation suit adopts a four-layer structure: the outermost layer is a conductive fabric, the second layer is a flame-resistant fabric, the third layer is carbon fiber thermal insulation mat, and the innermost layer is a lining fabric. The second layer and the third layer compose thermal insulation flame-resistant layers. The insulation suit can protect people from high voltage electric fields and currents and can protect people against high temperature of about 200° C.

CN101524188A relates to 1000 kV extra-high-voltage alternating current electrostatic protective clothing. The fabric comprises a blended spun yarn, comprising stainless steel fiber and textile fiber. The stainless steel fiber accounts for 10 to 30 percent of the blended yarn; and the ratio of polyester fiber to cotton fiber in the blended yarn is 1.86: 1. The fabric construction is a 2/1 twill weave. Shielding efficiency of clothing is larger than 33 dB, the resistance value of the clothing is smaller than 300 Ohm, and the field strength value in the whole protective clothing is smaller than 15 kV/m.

CN101194762A describes shielding clothing for alternating current high voltage electrification operations. The clothing is especially suitable for workers on electric devices with super high voltages of 1000 kV. The clothing comprises a coat and trousers. The invention also comprises a cap, a shielding mask, and conductive socks. The fabric materials of the cap, coat, trousers, conductive glove and the conductive socks are made by a doubler-twisting process of the blended yarns out of stainless steel fiber and flame-proof fiber, wherein the stainless steel fiber content is 40 to 50 percent.

DE19743389A1 describes protective clothing for persons working on high-voltage installations up to 800 kV. The clothing has an electrically conductive layer between a flame retardant outer layer and a body fluid-absorbing inner layer. The electrically conductive layer forms a Faraday screen around the wearer and has low electrical resistance. The electrically conductive layer is a fabric, coated with a metallic coating, e.g. silver or copper, such that the fibers of the fabric are covered by the metallic coating.

GB1221724A describes a suit, including a hood. The suit is made of textile fabric with a mesh network of metal conductors woven into the fabric, providing electrical contact at each crossing point of the mesh, and strips of metal foil or conducting ribbon (e.g. textile material with metallic threads) in seams of the fabric electrically connected together and to the conductors to provide higher conductance paths between the extremities of the suit. The strips are additionally all connected to at least one strip directly connected to a terminal connection for an external lead. The suit comprises a one piece garment with gloves and socks and is made of flame proof cotton fabric with a stainless steel mesh and aluminium foil strips extending from the legs, arms and hood and suit front respectively to the terminal block. As well as providing conducting paths the strips also serve to reinforce the cotton fabric.

DE9400193U1 describes a two-layer, permanently electrically conductive textile fabric to protect against low and high frequency electromagnetic fields. The top part of the fabric is formed out of a homogeneous blended yarn consisting of textile fibers and stainless steel fibers. The bottom part of the fabric is made out of a yarn made from pure textile fibers.

WO2011/096606A1 discloses an electromagnetic wave shielding yarn including a wick, a conductor disposed to be wound on the wick, at least part of the conductor made of a conductive material for shielding electromagnetic waves, and a coating unit disposed to wrap up the conductor so as to coat the conductor, resulting in implementation of an electromagnetic wave shielding yarn which is flexible and capable of adjusting performance of shielding electromagnetic waves according to a selection of diameters.

WO2004/02713A1 discloses an electrically conductive thread. The thread comprises at least one elastic core thread, at least one electrically conductive thread that is wound around the core thread. At least one further thread is wound around the core thread; the further thread can be a metallized yarn, e.g. silver plated nylon.

DISCLOSURE OF INVENTION

It is a first objective of the invention to provide an improved electromagnetic shielding fabric, e.g. for protective clothing for workers. It is a specific objective of at least some embodiments of the invention to provide an improved electromagnetic shielding fabric for protective clothing for workers working near high-voltage electricity lines. It is a particular objective of at least some embodiments of the invention to provide a fabric with excellent shielding properties against low and high-frequency electromagnetic waves; and with excellent electrical conductivity. It is an objective of at least some embodiments of the invention to provide a fabric that maintains its electromagnetic shielding properties and its electrical conductivity after multiple laundry operations. It is an objective of at least some embodiments of the invention to provide an improved electromagnetic shielding fabric that is flame-retardant. It is a specific objective of at least some embodiments of the invention to provide fabrics for protective clothing and protective clothing fulfilling the requirements of Standard CEI/IEC 60895: 2002 (of the International Electrotechnical Commission).

It is a further objective of the invention to provide a yarn for the manufacture of the shielding fabric of the first object of the invention.

The first aspect of the invention is an assembled yarn. Preferably, the assembled yarn is for use in an electromagnetic shielding fabric, more preferably for use in protective clothing. The assembled yarn comprises a first yarn and a second yarn. The first yarn comprises a core yarn and a first wrap yarn. The core yarn comprises a spun yarn, wherein the spun yarn comprises a blend of fibers, wherein the blend of fibers comprises first electrically conductive fibers, e.g. stainless steel fibers. With electrically conductive fibers is meant fibers of discrete length, opposed to filaments which have an indefinite length. The first wrap yarn comprises or consists out of one or a plurality of metallic filaments. The first wrap yarn is wrapped around the core yarn with at least 300 turns per meter. The second yarn comprises second electrically conductive fibers. The second yarn is wrapped around the first yarn; or the second yarn is ply-twisted with the first yarn thereby forming a plied yarn.

In embodiments wherein the second yarn is wrapped around the first yarn, preferably the second yarn is wrapped around the first yarn with at least 300 turns per meter. In embodiments wherein the second yarn is ply-twisted with the first yarn thereby forming a plied yarn, the ply-twist is preferably at least 200 turns per meter.

The second aspect of the invention is an electromagnetic shielding fabric. The electromagnetic shielding fabric can e.g. be used in protective clothing, e.g. for workwear for workers working at high voltage electricity lines. The electromagnetic shielding is a woven fabric. The fabric comprises electrically conductive yarns in the warp direction and in the weft direction of the fabric. The warp direction or the weft direction, or the warp direction and the weft direction, comprise an assembled yarn as in any embodiment of the first aspect of the invention as electrically conductive yarn. A preferred fabric has a specific mass of more than 150 g/m$^2$, preferably of more than 200 g/m$^2$. Preferably, the fabric has a specific mass less than 350 g/m$^2$; more preferably less than 300 g/m$^2$. Alternatively, the electromagnetic shielding fabric can be a knitted fabric comprising assembled yarns as in the first aspect of the invention.

The electromagnetic shielding fabric of the second aspect of the invention has shown to provide excellent electromagnetic shielding properties in a broad range of frequencies, from 50 Hz to 30 GHz, in combination with excellent electrical conductivity. Excellent electrical conductivity is important to protect the person wearing the protective clothing from induced voltages; and for the protective clothing to act as Faraday cage. The shielding properties and the electrical conductivity are maintained after multiple laundry operations. The electrical conductivity has been shown to be surprisingly high. At least some of the embodiments fulfil the electrical requirements (electrical resistance, current carrying capability, shielding and screening efficiencies) of standard CEI/IEC 60895:2002, before and after multiple laundry. The assembled yarn of the first aspect of the invention allows manufacturing the fabric of the second aspect of the invention; using the assembled yarn of the first aspect of the invention in weft and/or in warp direction of the woven fabric.

Embodiments of the second aspect of the invention have shown to fulfil the flame retardant requirements of the standard CEI/IEC 60895:2002 as well.

Standard CEI/IEC 60895:2002 (of the International Electrotechnical Commission) provides specifications for protective conductive clothing for use at nominal voltage up to 800 kV AC and approximately 600 kV DC. The standard applies to conductive clothing, either assembled from component parts or forming a single complete clothing, worn by skilled persons during live working at a nominal power system voltage up to 800 kV AC and about 600 kV DC. It is applicable to conductive jackets, trousers, coveralls (one-piece clothing), gloves or mitts, hoods, shoes, overshoe socks and socks. The requirements listed in CEI/IEC 60895:2002 are flame retardancy, electrical resistance, current carrying capability, shielding and screening efficiencies, requirements to withstand cleaning; and spark-discharge protection. The standard also describes the test methods to be used to test these required properties.

In a preferred assembled yarn the metallic filament has a diameter between 20 and 80 μm; more preferably between 35 and 60 μm.

In a preferred assembled yarn, the first wrap yarn consists out of one metallic filament.

In a preferred assembled yarn, the core yarn comprises polyamide fibers.

In a preferred assembled yarn, the metallic filament comprises or is a stainless steel filament or a silver plated copper filament or a silver filament or a metal plated copper filament or a metal plated steel filament. Preferred examples of metal plated copper filaments are e.g. nickel plated copper filaments or tin plated copper filaments. Preferred stainless steel filaments are metal plated stainless steel filaments or metal coated stainless steel filaments; preferred is the use of metal plating or a metal coating that increases the electrical conductivity of the filament. When copper is mentioned, it has to be understood that alloys comprising more than 50% by weight—and preferably more than 70% by weight—of copper are included.

In a preferred assembled yarn, the second conductive fibers are stainless steel fibers.

In a preferred assembled yarn, the second yarn comprises or consists out of a spun yarn from a blend of fibers. The blend of fibers comprises second electrically conductive fibers, preferably stainless steel fibers. More preferably, the second yarns comprises at least 20% by weight of stainless steel fibers, even more preferably at least 25% by weight, even more preferably at least 30% by weight. And preferably less than 45% by weight of stainless steel fibers.

In a preferred assembled yarn, the second yarn comprises flame retardant fibers, e.g. made up of a fiber or blend of fibers selected from the group consisting of meta-aramid, para-aramid, polyimide, polybenzimidazole (PBI), polyimide-amide, polybenzoxazole, melamine fibers, modacrylic, flame retardant viscose fibers or fibers treated with a flame retardant finish.

In a preferred embodiment, the second yarn comprises modacrylic fibers and viscose fibers; or the second yarn comprises modacrylic fibers and cotton fibers.

In a preferred assembled yarn, the core yarn comprises flame retardant fibers, e.g. made up of a fiber or blend of fibers selected from the group consisting of meta-aramid, para-aramid, polyimide, polybenzimidazole (PBI), polyimide-amide, polybenzoxazole, melamine fibers, modacrylic, flame retardant viscose fibers, or fibers treated with a flame retardant finish.

In a preferred embodiment, the core yarn comprises modacrylic fibers and viscose fibers;

or the second yarn comprises modacrylic fibers and cotton fibers.

In a preferred assembled yarn, the core yarn comprises para-aramid fibers. Para-aramid fibers are preferred in the blend of the core yarn as they provide strength to the yarn; and limit its shrinkage.

In a preferred assembled yarn, the core yarn comprises meta-aramid and para-aramid fibers. Para-aramid fibers are preferred in the blend of the core yarn as they provide strength to the yarn; and limit its shrinkage.

Preferably, the core yarn comprises at least 20% by weight of stainless steel fibers, even more preferably at least 25% by weight, even more preferably at least 30% by weight. And preferably less than 45% by weight of stainless steel fibers.

In a preferred assembled yarn, the core yarn comprises meta-aramid fibers, para-aramid fibers and first electrically conductive fibers, e.g. stainless steel fibers. Para-aramid fibers are preferred in the blend of the core yarn as they provide strength to the yarn; and limit its shrinkage.

In a preferred assembled yarn, the second yarn is wrapped around the first yarn. The first wrap yarn is wrapped in a first direction around the core yarn. The second yarn is wrapped around the first yarn in the direction opposite to the first direction; preferably with the same number of turns per meter.

In a preferred assembled yarn, the core yarn is a spun yarn wherein the fibers are twisted in a first direction. The first direction can be in Z-direction or in S-direction. The first wrap yarn is wrapped in the first direction around the core yarn; this means that if the core yarn is a spun yarn wherein the fibers are twisted in Z-direction, the first yarn is wrapped in Z-direction around the core yarn. The second yarn is a spun yarn wherein the fibers are twisted in the first direction; this means that if the first direction is the Z-direction, the second yarn is a spun yarn wherein the fibers are twisted in Z-direction. The second yarn is wrapped around the first yarn in the opposite direction to the first direction; this means that if the first direction is the Z-direction that the second yarn is wrapped around the first yarn in S-direction. It is an advantage of such embodiments that an assembled yarn is obtained that has less torque; and therefore, can more easily be processed into high quality products, e.g. high quality fabrics.

In a preferred assembled yarn wherein the second yarn is wrapped around the first yarn;

the assembled yarn comprises a third yarn. The third yarn comprises third electrically conductive fibers. The third yarn is wrapped around the core yarn in the opposite direction of wrapping of the second yarn. It is an advantage of such embodiments that an assembled yarn is obtained that has less torque; and therefore, can more easily be processed into high quality products. In a more preferred embodiment, the third yarn has the same composition and yarn structure as the second yarn.

In a preferred assembled yarn wherein the second yarn is ply-twisted with the first yarn thereby forming a plied yarn; the assembled yarn comprises a third yarn. The third yarn comprises third electrically conductive fibers, preferably stainless steel fibers. The third yarn is ply-twisted with the first yarn and with the second yarn. It is an advantage of such embodiments that an assembled yarn is obtained that has less torque; and therefore, can more easily be processed into high quality products. In a more preferred embodiment, the third yarn has the same composition and yarn structure as the second yarn.

A preferred woven electromagnetic shielding fabric comprises assembled yarns as in any embodiment of the first aspect of the invention. Assembled yarns are present in the weft with a constant density, expressed as number of yarns per unit of length.

A preferred woven electromagnetic shielding fabric comprises assembled yarns as in any embodiment of the first aspect of the invention. Assembled yarns are present in the warp with a constant density, expressed as number of yarns per unit of length.

A preferred woven electromagnetic shielding fabric comprises assembled yarns as in any embodiment of the first aspect of the invention. Assembled yarns are present in the weft with a constant density, expressed as number of yarns per unit of length. Assembled yarns are present in the warp with a constant density, expressed as number of yarns per unit of length. The density of the assembled yarns in warp and in weft can be but is not necessary the same. Preferred however is a same density of assembled yarns in weft and in warp of the woven fabric.

A preferred electromagnetic shielding fabric comprises a flame retardant finish.

In a preferred woven electromagnetic shielding fabric, the warp direction and the weft direction comprise assembled yarns as in any embodiment of the first aspect of the invention as electrically conductive yarn. The warp direction comprises a second type of warp yarns. The weft direction comprises a second type of weft yarns. In the warp one or more than one second type of warp yarns alternate with one or more than one assembled yarns. In the weft one or more than one second type of weft yarns alternate with one or more than one assembled yarns. As an example of such embodiments, a number (e.g. one or two or three or four) of the second type of warp yarns are provided between each two assembled yarns in warp direction; and a number (e.g. one or two or three or four) of the second type of weft yarns are provided between each two assembled yarns in weft direction. As another example of such embodiments, one yarn of the second type of warp yarns is provided between groups of two, three or four assembled yarns in warp direction; and one yarn of the second type of weft yarns is provided between groups of two, three or four assembled yarns in weft direction. In preferred embodiments of woven electromagnetic shielding fabrics, the electromagnetic shielding fabric comprises—in warp direction and/or in weft direction—assembled yarns as in the first aspect of the invention wherein the second yarn is wrapped around the first yarn. The second type of warp yarns and the second type of weft yarns are plied yarns, preferably two-ply yarns; preferably comprising conductive fibers, more preferably stainless steel staple fibers.

A preferred woven fabric comprises in warp direction and/or in weft direction a first set of assembled yarns as in the first aspect of the invention; and a second set of assembled yarns as in the first aspect of the invention. In the first set of assembled yarns the first wrap yarn comprises or consists out of one or a plurality of stainless steel filaments. In the second set of assembled yarns the first wrap yarn comprises or consists out of one or a plurality of metal plated copper filaments, e.g. one or a plurality of silver plated copper filaments. In warp and/or in weft direction of the woven fabric, yarns of the first set of assembled yarns alternate according to a pattern with yarns of the second set of assembled yarns. Such fabrics have the benefit that they are more durable, e.g. as they are more resistant to human transpiration, in the sense that the shielding properties and electrical conductivity is better retained. As an example the repeated pattern can comprise two assembled yarns of the first set of assembled yarns and one assembled yarn of the second set of assembled yarns. As another example the repeated pattern can contain one assembled yarn of the first set of assembled yarns and one assembled yarn of the second set of assembled yarns.

The third aspect of the invention is an apparel product, e.g. protective clothing, comprising an electromagnetic shielding fabric as in any embodiment of the second aspect of the invention.

In a preferred apparel product, the first side of the electromagnetic shielding fabric provides the outer side of the apparel product. The second side of the electromagnetic shielding fabric provides the inner side of the apparel product. It is a benefit of such embodiments that no lining is used in the apparel product.

A preferred apparel product comprises at least two panels of electromagnetic shielding fabric as in any embodiment of the second aspect of the invention. The apparel product comprises a stitching yarn. The at least two panels are stitched together by means of the stitching yarn. The stitching yarn comprises electrically conductive fibers, preferably the electrically conductive fibers comprise or consist out of stainless steel fibers. It is a benefit of this embodiment that an apparel product is obtained that has excellent electromagnetic shielding and electrical conductivity properties.

The assembled yarn as in any embodiment of the first aspect of invention can e.g. be used in a fabric embedded in plaster of mortar in constructions, e.g. in building plaster. Such fabric can e.g. be a scrim, e.g. a laid scrim, e.g. combined with polyester yarns. The electromagnetic shielding fabrics of the invention can e.g. by used as shielding fabric embedded in plaster or mortar in constructions, e.g. in building plaster.

The assembled yarn as in any embodiment of the first aspect of invention can e.g. be used in a wall covering fabric in order to shield from electromagnetic waves. The electromagnetic shielding fabric of the invention can e.g. be used as wall covering in order to shield from electromagnetic waves.

The assembled yarn as in any embodiment of the first aspect of invention can e.g. be used in a shielding curtain in order to shield from electromagnetic waves. The electromagnetic shielding fabric of the invention can e.g. be used as shielding curtain.

An aspect of the invention is stable boots for horses. The stable boots for horses comprise an assembled yarn as in any embodiment of the first aspect of the invention or comprise an electromagnetic shielding fabric as in any embodiment of the second aspect of the invention.

In an aspect of the invention, products are provided comprising the electromagnetic shielding fabric of the invention. The products are provided for being wrapped or placed on the area of amputations of arms or legs. Such shielding against electromagnetic fields can reduce the phantom pains in amputated legs or arms.

An aspect of the invention is pregnancy clothing comprising an assembled yarn as in the first aspect of the invention; or comprising an electromagnetic shielding fabric as in the second aspect of the invention. The pregnancy clothing provides shielding of the unborn child in the womb from electromagnetic radiation.

An aspect of the invention is a sensor, comprising an assembled yarn as in any embodiment of the first aspect of the invention.

An aspect of the invention is a textile heating product, comprising an assembled yarn as in any embodiment of the first aspect of the invention; wherein in the textile heating product—when the product is in use—heat is generated by the Joule effect in the assembled yarn.

MODE(S) FOR CARRYING OUT THE INVENTION

An exemplary fabric according to the second aspect of the invention has been made. The fabric comprises in weft and in warp direction the same assembled yarn according to the first aspect of the invention. The assembled yarn comprises a core yarn which is a spun yarn of count Nm50/1 (20 tex) out of an intimate blend of polyester fibers (70% by weight) and stainless steel fibers (30% by weight); the core yarn is twisted in Z-direction. The core yarn is wrapped with a 40 μm diameter silver plated copper filament as first wrap yarn. Alternatively, a 50 μm diameter (or a 30 μm diameter) stainless steel fiber filament can be used as first wrap yarn. The metallic filament is e.g. wrapped in Z-direction with 1000 turns per meter around the core yarn. The second yarn is a spun yarn of count Nm 50/1 (20 tex) out of an intimate blend of polyester fibers (70% by weight) and stainless steel fibers (30% by weight). The second yarn is twisted in Z-direction. The second wrap is wrapped in S-direction with 1000 turns per meter around the combination of the core yarn and the first wrap yarn. The fabric construction is a 2/1 twill weave. In an example, the fabric was woven consisting out of 25 assembled yarns in weft per centimeter and 31 assembled yarns per centimeter in warp direction, the weight of the fabric was approximately 300 g/m$^2$.

In another example, the core yarn comprises meta-aramid fibers in addition to or replacing the polyester fibers of the first example; and the second wrap comprises meta-aramid fibers in addition to or replacing the polyester fibers of the first example.

An example of the invention is a woven fabric for use in protective clothing, e.g. for workwear for workers working at high voltage electricity lines. The fabric comprises an assembled yarn in the warp direction and in the weft direction. The assembled yarn comprises a first yarn and a second yarn. The first yarn comprises a core yarn and a first wrap yarn. The core yarn is a Nm 40/1 (25 tex) blended spun yarn comprising 70% by weight meta-aramid fibers, 5% by weight para-aramid fibers and 25% by weight stainless steel fibers. The first wrap yarn consists out of one silver-coated copper filament of 40 pm diameter, wrapped around the core yarn with 1000 turns per meter. The second yarn is a Nm 40/1 (25 tex) blended spun yarn comprising 70% by weight meta-aramid fibers, 5% by weight para-aramid fibers and 25% by weight stainless steel fibers. In a first example, the second yarn is wrapped around the first yarn, with at least 300 turns per meter. In a second example, the second yarn is ply-twisted, with 300 turns per meter, with the first yarn thereby forming a plied yarn. In an example, the fabric was woven consisting out of 22 assembled yarns per centimetre in the weft and 27 assembled yarns per centimetre in warp direction, the weight of the fabric was approximately 315 g/m$^2$.

In another example, a fabric was woven with 22 weft yarns per centimetre and with 27 warp yarns per centimetre, in weft direction 2 assembled yarns were alternated with 1 blended yarn and in warp direction 1 assembled yarn was alternated with 2 blended yarns as described in this paragraph, the weight of the fabric was approximately 280 g/m$^2$.

An example of the invention is a woven fabric for use in protective clothing, e.g. for workwear for workers working at high voltage electricity lines. The fabric comprises an assembled yarn in the warp direction and in the weft direction. The assembled yarn comprises a first yarn and a second yarn. The first yarn comprises a core yarn and a first wrap yarn. The core yarn is a Nm 50/1 (20 tex) blended spun yarn comprising 65% by weight meta-aramid fibers, 5% by weight para-aramid fibers and 30% by weight stainless steel fibers. The first wrap yarn consists out of one silver plated copper filament of 40 μm diameter, wrapped around the core yarn with 1000 turns per meter. The second yarn is a Nm 50/1 (20 tex) blended spun yarn comprising 65% by weight meta-aramid fibers, 5% by weight para-aramid fibers and 30% by weight stainless steel fibers. In a first example, the second yarn is wrapped around the first yarn, with at least 1000 turns per meter. In a second example, the second yarn is ply-twisted, with 600 turns per meter, with the first yarn thereby forming a plied yarn. In an example, the fabric was woven consisting out of 20 assembled yarns in weft per centimetre and 20 assembled yarns per centimetre in warp direction, the weight of the fabric was 250 g/m$^2$.

The woven fabric can be made consisting in weft and in warp direction out of the assembled yarns of the previous paragraphs. It is also possible to position in weft and in warp direction in between two consecutive assembled yarns other yarns; e.g. Nm 50/2 (20*2 tex) blended yarns consisting out of an intimate blend of 65% by weight meta-aramid fibers, 5% by weight para-aramid fibers and 30% by weight stainless steel fibers, and having 600 turns per meter ply twist. E.g. 1, 2, 3 or more of such yarns can be provided between each two consecutive assembled yarns. In an example, a fabric was woven with 20 weft yarns per centimetre and with 20 warp yarns per centimetre, in each direction assembled yarns and blended yarns as described in this paragraph were alternated.

Several weaves of the fabric are possible, e.g. plain weave, twill weaves, satin weave, ripstop weaves, chevron twill weaves. Preferred is a reinforced twill weave.

The electromagnetic shielding fabrics of the invention show excellent electrical conductivity, even after laundry. The electrical conductivity of an inventive fabric has been measured between two electrodes that make a point contact with the fabric. After 10 laundry cycles, the electrical resistance of the fabric is below 0.7 Ohm per meter distance between the point electrodes, in warp direction, in weft direction and in the direction making a 45° angle with the warp and with the weft direction. After 20 laundry cycles, the electrical resistance of the fabric was still below 1.2 Ohm per meter distance between the point electrodes in each of the three test direction.

The electromagnetic shielding fabric according to the invention showed excellent electromagnetic shielding results in a broad range of frequencies.

The invention claimed is:

1. An assembled yarn comprising a first yarn and a second yarn,
- wherein the first yarn comprises a core yarn and a first wrap yarn,
  - wherein the core yarn comprises a spun yarn,
    - wherein the spun yarn comprises a blend of fibers,
      - wherein the blend of fibers comprises first electrically conductive fibers,
    - wherein the first wrap yarn comprises one or a plurality of metallic filaments, and
    - wherein the first wrap yarn is wrapped around the core yarn with at least 300 turns per meter,
  - wherein the second yarn comprises a spun yarn from a blend of fibers,
    - wherein the blend of fibers comprises second electrically conductive fibers, and
      - wherein the second electrically conductive fibers are stainless steel fibers, and
  - wherein the second yarn is either
    - wrapped around the first yarn; or
    - ply-twisted with the first yarn thereby forming a plied yarn.

2. The assembled yarn according to claim 1,
- wherein the one or the plurality of metallic filaments comprises a stainless steel filament a silver plated copper filament, a silver filament, a metal plated copper filament, or a metal plated steel filament.

3. The assembled yarn according to claim 1,
- wherein the first conductive fibers are stainless steel fibers.

4. The assembled yarn according to claim 1,
- wherein the second yarn is wrapped around the first yarn,
- wherein the first wrap yarn is wrapped in a first direction around the core yarn,
- and
- wherein the second yarn is wrapped around the first yarn in the direction opposite to the first direction.

5. The assembled yarn according to claim 1,
- wherein the fibers of the spun yarn of the core yarn are twisted in a first direction,
- wherein the first wrap yarn is wrapped in a first direction around the core yarn,
- wherein the second yarn is a spun yarn having fibers that are twisted in the first direction, and
- wherein the second yarn is wrapped around the first yarn in the opposite direction to the first direction.

6. An electromagnetic shielding fabric comprising the assembled yarn according to claim 1, wherein the electromagnetic shielding fabric is a knitted fabric.

7. An electromagnetic shielding fabric
- comprising electrically conductive yarns in a warp direction and in a weft direction of the electromagnetic shielding fabric,
- wherein the electromagnetic shielding fabric is a woven fabric, and
- wherein the warp direction or the weft direction or the warp direction and the weft direction comprise the assembled yarn according to claim 1 as an electrically conductive yarn.

8. The electromagnetic shielding fabric according to claim 7,
- wherein the electromagnetic shielding fabric comprises the assembled yarn as electrically conductive yarn in the warp direction and the weft direction,
- wherein the warp direction comprises a second type of warp yarns and wherein the weft direction comprises a second type of weft yarns,
- wherein, in the warp direction, one or more than one second type of warp yarns alternates with one or more than one assembled yarn, and
- wherein, in the weft direction, one or more than one second type of weft yarns alternates with one or more than one assembled yarns.

9. The electromagnetic shielding fabric according to claim 7,
- wherein the woven fabric comprises, in the warp direction and/or in the weft direction, a first set of the assembled yarn and a second set of the assembled yarn,
- wherein, in the first set of the assembled yarn, the first wrap yarn comprises one or a plurality of stainless steel filaments,
- wherein, in the second set of the assembled yarn, the first wrap yarn comprises one or a plurality of metal plated copper filaments, and
- wherein, in the warp and/-or in the weft direction of the woven fabric, yarns of the first set of assembled yarn alternate according to a pattern with yarns of the second set of assembled yarn.

10. An apparel product comprising the electromagnetic shielding fabric according to claim 6.

11. The apparel product according to claim 10,
- wherein the electromagnetic shielding fabric has a first side that provides an outer side of the apparel product, and
- wherein the electromagnetic shielding fabric has a second side that provides an inner side of the apparel product.

12. An apparel product comprising at least two panels of an electromagnetic shielding fabric comprising electrically conductive yarns in a warp direction and in a weft direction of the electromagnetic shielding fabric, wherein the electromagnetic shielding fabric is a woven fabric, wherein the warp direction or the weft direction or the warp direction and the weft direction comprise the assembled yarn according to claim 1 as an electrically conductive yarn, wherein the apparel product comprises a stitching yarn, wherein the at least two panels of the electromagnetic shielding fabric are stitched together by means of the stitching yarn, and wherein the stitching yarn comprises electrically conductive fibers.

13. A sensor comprising the assembled yarn according to claim 1.

14. A textile heating product comprising the assembled yarn according to claim 1, wherein, when the textile heating product is in use, heat is generated by the Joule effect in the assembled yarn.

* * * * *